United States Patent [19]

Gorzegno

[11] 4,430,094

[45] Feb. 7, 1984

[54] VAPOR GENERATING SYSTEM HAVING A PLURALITY OF INTEGRALLY FORMED GASIFIERS EXTENDING TO ONE SIDE OF AN UPRIGHT WALL OF THE GENERATOR

[75] Inventor: Walter P. Gorzegno, Morristown, N.J.

[73] Assignee: Foster Wheeler Energy Corporation, Livingston, N.J.

[21] Appl. No.: 332,632

[22] Filed: Dec. 21, 1981

[51] Int. Cl.[3] ..... C10K 3/00

[52] U.S. Cl. ..... 48/76; 48/128; 48/DIG. 4; 48/77; 34/57 A; 122/4 D; 122/5; 110/229

[58] Field of Search ..... 48/128, DIG. 4, 76, 48/77; 110/229; 34/57 A; 122/4 D, 5

[56] References Cited

U.S. PATENT DOCUMENTS

| | | | |
|---|---|---|---|
| 1,722,495 | 10/1929 | Chapman . | |
| 1,802,475 | 4/1931 | Lucke . | |
| 2,619,451 | 11/1952 | Ogorzaly et al. | 202/12 |
| 2,741,549 | 6/1956 | Russell | 48/206 |
| 3,581,715 | 6/1971 | Singer | 122/5 |
| 3,587,489 | 6/1971 | Demar | 110/31 |
| 3,599,610 | 8/1971 | Spector | 122/5 |
| 3,784,676 | 1/1974 | Moss | 423/242 |
| 3,807,090 | 4/1974 | Moss | 48/128 |
| 3,818,869 | 6/1974 | Blaskowski | 122/5 |
| 3,905,336 | 9/1975 | Gamble et al. | 122/4 D |
| 4,172,431 | 10/1979 | Tatem | 122/5 |
| 4,186,669 | 2/1980 | Cowan et al. | 110/347 |
| 4,332,218 | 6/1982 | Stewart et al. | 34/57 A X |
| 4,344,371 | 8/1982 | Zoschak | 48/128 X |

*Primary Examiner*—Arthur D. Kellogg

*Attorney, Agent, or Firm*—Marvin A. Naigur; John E. Wilson; Warren B. Kice

[57] ABSTRACT

A vapor generating system in which a furnace section is provided that is formed by four upright walls. A plurality of openings are formed in one of the walls, and a plurality of gasifiers extend adjacent said one wall and surround the openings so that the respective interiors of the gasifiers communicate with the openings. A bed of adsorbent material is supported in each gasifier for adsorbing the sulfur generated as a result of the gasification of fuel introduced into the gasifier, and air is passed through the bed of adsorbent material to fluidize said material so that, upon combustion of said fuel, a substantially sulfur-free product gas is produced which passes from the gasifier, through the openings and into the furnace section.

12 Claims, 3 Drawing Figures

VAPOR GENERATING SYSTEM HAVING A PLURALITY OF INTEGRALLY FORMED GASIFIERS EXTENDING TO ONE SIDE OF AN UPRIGHT WALL OF THE GENERATOR

BACKGROUND OF THE INVENTION

This invention relates to a vapor generating system and, more particularly, to such a system in which a vapor generator burns a relatively low BTU product gas essentially free of sulfur which is generated by a gasifier located integral with the vapor generator.

The Environmental Protection Agency and various state agencies have established standards of performance that define maximum allowable sulfur dioxide emission levels for fossil fueled power stations. In response to these standards, a generation of stack gas clean up equipment has been designed to remove or scrub sulfur dioxide from the steam generator flue gases prior to release into the atmosphere. Since large volumes of gas with dilute sulfur dioxide concentrations are encountered at the steam generator exit, the stack gas clean up equipment becomes large and expensive.

Instead of controlling sulfur dioxide emissions by treating the stack gases it is advantageous to remove sulfur from the fuel prior to combustion in the steam generator, since at this stage the volume of gases requiring treatment is significantly reduced. To this end a gasification process has evolved that involves the partial combustion of fuel, such as particulate coal, or heavy fuel oil in a fluidized bed of lime particles. Desulfurization is accomplished through reaction with the lime particles and a combustible off-gas is produced that is ducted to a steam generator where combustion is completed in commercially available gas burners.

However, in these systems, hot gas ducting has to be provided, along with a cyclone separator in the case of particulate coal, to pass the product gas from the gasifier to the steam generator. However, this equipment is expensive and, in addition, since the cyclone separators were less than completely efficient, the coal particles would enter the ducting to the burners and cause an appreciable build up of carbon. Therefore, the gasifier had to be designed to permit periodical carbon burn-up in the ducting, which compromised the efficiency of the system.

SUMMARY OF THE INVENTION

It is therefore an object of the present invention to provide a vapor generating system in which sulfur is removed from the fuel prior to combustion in the vapor generator.

It is a further object of the present invention to provide a system of the above type in which a chemically active fluidized bed is provided for producing a product gas substantially free of sulfur which is passed to the vapor generator.

It is a still further object of the present invention to provide a system of the above type in which the sulfur free product gas is generated in a gasifier and passed to the vapor generator without the use of ducting and/or cyclone separators.

It is a still further object of the present invention to provide a system of the above type in which two-stage combustion is achieved, with sulfur removal in the gasifier, and combustion of the gas together with the carbon particulate in the furnace.

It is a still further object of the present invention to provide a system of the above type in which a gasifier is formed integrally with the vapor generator, and is supported in the same manner as the vapor generator.

It is a still further object of the present invention to provide a system of the above type in which a plurality of gasifiers are provided to one side of an upright wall of the furnace section of the vapor generator.

Toward the fulfillment of these and other objects, the system of the present invention comprises a vapor generator including an upright furnace section. A plurality of gasifiers are respectively provided adjacent one of the walls and each supports a bed of adsorbent material for the sulfur generated as a result of the combustion of fuel introduced into the bed. Air is passed through the bed of adsorbent material to fluidize the material so that, upon combustion of the fuel, a substantially sulfur-free product gas is produced. The gasifiers communicate with the interior of the furnace section so that the product gas from the gasifier passes into the furnace section for combustion.

BRIEF DESCRIPTION OF THE DRAWINGS

The above description, as well as further objects, features and advantages of the present invention will be more fully appreciated by reference to the following detailed description of the presently preferred but nonetheless illustrative embodiment in accordance with the present invention when taken in conjunction with the accompany drawings in which.

DESCRIPTION OF THE PREFERRED EMBODIMENT

Figure 1:
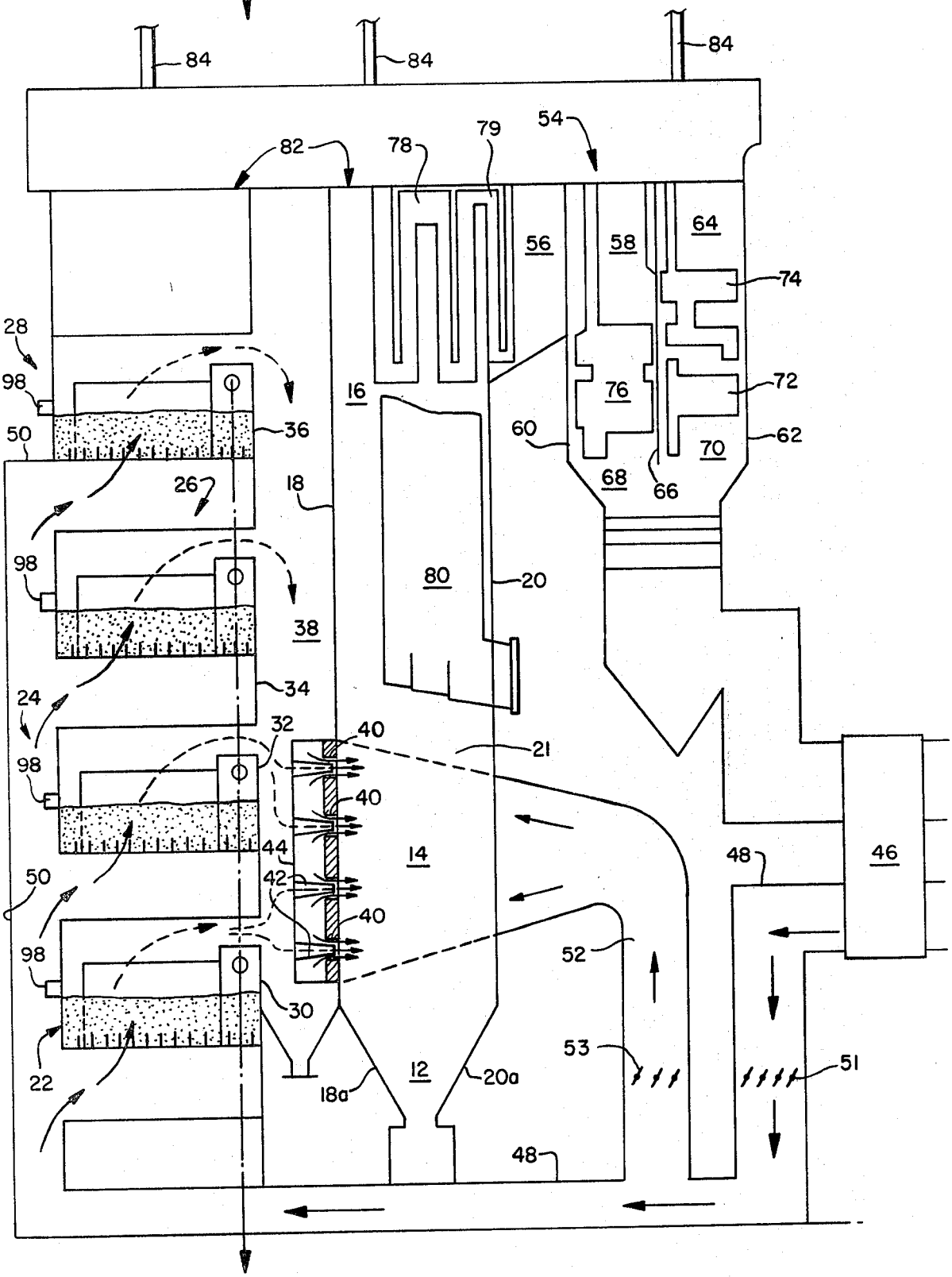
FIG. 1 is a schematic sectional view of the steam generating/gasifying system of the present invention.

Referring specifically to FIG. 1 of the drawings, the reference numeral 10 refers in general to a vapor generator utilized in the system of the present invention which includes a lower furnace section 12, an intermediate furnace section 14, and an upper furnace section 16. The boundary walls defining the furnace sections 12, 14 and 16 include a front wall 18, a rear wall 20 and two sidewalls extending between the front and rear wall, with one of said sidewalls being referred to by the reference numeral 21.

Although only shown schematically for the convenience of presentation, it is understood that each of the walls 18, 20 and 21 are formed of a plurality of tubes having continuous fins extending outwardly from diametrically opposed portions thereof, with the fins of adjacent tubes being connected together in any known manner, such as by welding, to form a gas-tight structure.

The lower portions of the front wall 18 and the rear wall 20 are sloped inwardly from the intermediate furnace section 14, as shown by the reference numerals **18*a* and 20*a*, respectively, so that the lower furnace section 12** is in the form of a hopper.

Four integral gasifiers 22, 24, 26 and 28 are located to the side of the generator 10 and adjacent the front wall 18. The gasifiers 22, 24, 26 and 28 include vertical wall portions 30, 32, 34 and 36 respectively, extending in a parallel spaced relation to the front wall 18, to define a chamber 38 which communicates with a plurality of refractory aligned openings 40 formed along the lower portion of the front wall 18. A plurality of nozzles 42 are supported by a vapor generator windbox support structure 44 extending intermediate the front wall 18 and the wall portions 30 and 32, with the discharge end of each nozzle extending within a corresponding opening 40.

A preheater 46 is provided in a heat exchange relation with a duct 48 which receives air from an external source and conveys the preheated air to a windbox 50 which surrounds the gasifiers 22, 24, 26 and 28. The latter gasifiers are spaced apart vertically so that the preheated air from the windbox 50 enters each gasifier through a grate forming the floors of the gasifiers as will be described later. A series of dampers 51 are provided in the duct 48 for controlling the flow of air through the latter duct, the windbox 50 and into the gasifiers 22, 24, 26 and 28 as shown by the solid flow arrows. Further details of the arrangement and operation of the gasifiers 22, 24, 26 and 28 will be described later.

A duct 52 branches from the duct 48 and is connected to the vapor generator windbox support structure 44 in such a manner so as to direct a portion of the air from the duct 48 into and through the openings 40 in the front wall 18. A series of dampers 53 are provided in the duct 52 for controlling the flow of air through the latter duct.

A heat recovery area, shown in general by the reference numeral 54 is provided adjacent the upper furnace section 16 in gas flow communication therewith and includes a vestibule section 56 and a convection section 58.

The convection section 58 includes a front wall 60, a rear wall 62 and two sidewalls 64, with one of the latter being shown in FIG. 1. It is understood that the rear wall 62, the sidewalls 64 and the lower portions of the front wall 60 are all formed of a plurality of vertically extending, finned interconnected tubes in a similar manner to that of the furnace sections, and that screen openings are provided in the upper portion of the wall 60 to permit communication between the vestibule section and the convection section 58.

A partition wall 66, also formed by a plurality of finned interconnected tubes, is provided in the convection section 58 to divide the latter into a front gas pass 68 and a rear gas pass 70. An economizer 72 is disposed in the lower portion of the rear gas pass 70, a primary superheater 74 is disposed immediately above the economizer, and a bank of reheater tubes 76 is provided in the front gas pass 68.

A platen superheater 78 is provided in the upper furnace section 16 and a finishing superheater 79 is provided in the vestibule section 56 in direct fluid communication with the platen superheater 78.

A plurality of division walls, one of which is shown by the reference numeral 80, extend in the upper furnace section 16 with each wall being formed by a plurality of interconnected tubes. Each division wall 80 penetrates a portion of the tubes of the rear wall 20 and extends upwardly within the upper furnace section 16 as shown.

A roof 82 is disposed in the upper portion of the vapor generator 10 and consists of a plurality of tubes having fins connected in the manner described above but extending horizontally across the generator 10. The roof 82 is top supported to an upper support structure (not shown) by a plurality of support members 84 to permit thermal expansion of the entire structure including the vapor generator 10 and the gasifiers 22, 24, 26 and 28 in a downward direction, as viewed in the drawing.

Figure 2:
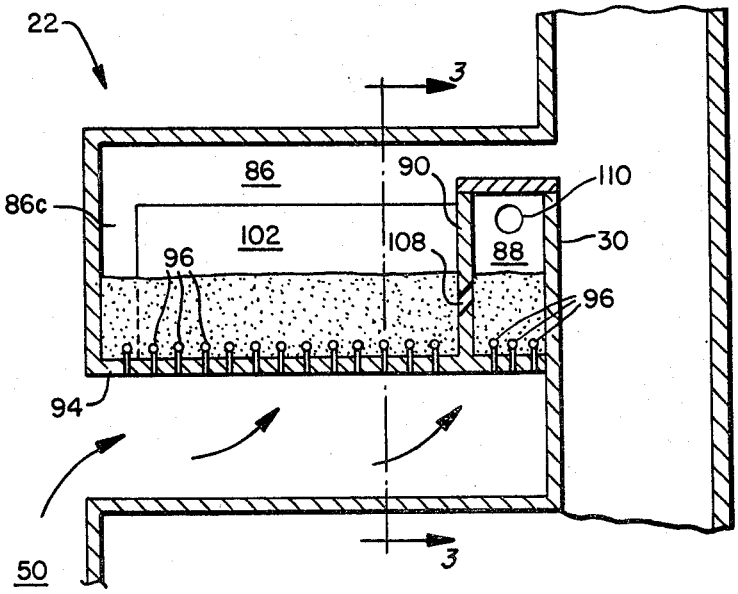
FIG. 2 is an enlarged sectional view depicting a portion of the system of FIG. 1.
Figure 3:
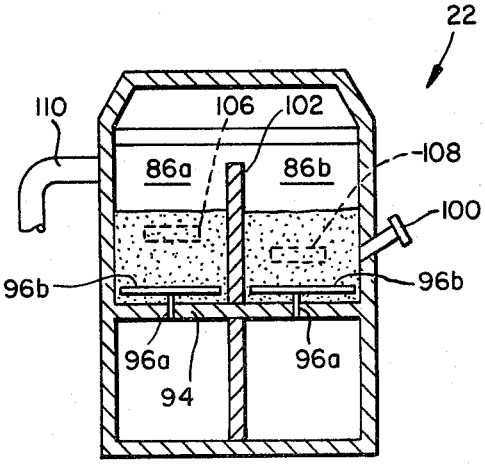
FIG. 3 is a cross-sectional view taken along the lines 3—3 of FIG. 2.

The gasifier 22 is shown in detail in FIGS. 2 and 3, it being understood that the other gasifiers 24, 26 and 28 are all constructed and arranged in an identical manner. The gasifier 22 includes a gasifying section 86 and a regenerating section 88 separated by a vertical wall 90 extending in a spaced, parallel relation to the wall 30. A grate 94 forms the floor of the gasifier 22 and is adapted to receive a plurality of T-shaped air distributor pipe assemblies 96 which receive air from the windbox 50 and introduces the air into the gasifying section 86 and the regenerating section 88. As better shown in FIG. 3, each pipe assembly 96 includes a vertical pipe 96*a* which extends through an opening in the grate 94 and a horizontal pipe 96*b* connected in registry with the vertical pipe.

A particulate coal feeder 98 (FIG. 1) is supported on the front upright wall of each gasifier 22, 24, 26 and 28 for continuously discharging particulate coal onto the fluidized bed in each gasifier. Alternately, a plurality of oil distributor pipe assemblies (not shown) could extend through other openings in the grate 94 below the gasifying section 86 with each assembly being connected to a source of oil for supplying source to the gasifiers.

A feeder 100 extends through a sidewall of the gasifier 22 and is adapted to feed an adsorbent, such as limestone, into the gasifying section 86.

A divider wall 102 is disposed in the gasifying section 86 to divide it into chamber 86*a* and 86*b* (FIG. 3). The divider wall 102 extends from the partition 90 (FIG. 2) to an area spaced from the opposite wall to define a passage 86*c* (FIG. 2) communicating with the chambers 86*a* and 86*b*.

An inlet slot 106 and an outlet slot 108 are formed in the partition 90 with the former communicating gasifying chamber 86*a* with the regenerating section 88 and the latter communicating the gasifying chamber 86*b* with the regenerating section.

As a result of this arrangement a mixture of limestone and fuel continually flows from the gasifying chamber 86*b*, around the passage 86*c*, through the gasifying chamber 86*a* and the slot 106 and into the regenerating section 88 and, from the latter section, through the slot 108 and into the gasifying chamber 86*b* for recirculation.

A discharge manifold 110 communicates with the upper portion of the regenerating section 88 to discharge the sulfur gas produced in the regenerating section to external sulfur recovery equipment (not shown). Towards this end the manifolds 110 from each gasifier 22, 24, 25 and 28 can be connected as shown by the dot-dashed line in FIG. 1 to provide a single source of the sulfur gas.

Since the gasifiers 24, 26 and 28 are arranged and operate in a manner identical to the gasifier 22, they will not be described in detail. In this context it is noted that the horizontal and vertical wall portions forming the gasifiers 22, 24, 26 and 28 can be water cooled as in the case of the other walls discussed above, i.e., they can be formed by a plurality of finned interconnected water tubes.

In operation, the temperature in each fluidized bed in the gasifying sections 86 of the gasifiers 22, 24, 26 and 28 is maintained at a predetermined elevated value (such as 1600° F.) by control of the fuel entering their respective beds. Air from the windbox 50, via the preheater 46 and the duct 48, is admitted into the gasifying section 86 of each gasifier through the air distributor pipe assemblies 96 in substoichiometric proportions to limit the amount of combustion and heat release.

Partial combustion of the fuel entering the gasifying section 86 with approximately 25 to 30% stoichiometric air furnishes sufficient heat to partially combust the fuel and, when oil is used, to vaporize and crack the remaining oil. This partial combustion results in the formation of hydrogen sulfide which reacts with the fluidized bed of lime to form calcium sulfide and water vapor. The gaseous product of this process is an essentially sulfur free and vanadium free fuel gas which rises in the gasifying section 86 and exits the latter section via spaces formed between the adjacent walls 30, 32, 34 and 36 as shown by the dashed flow arrows in FIG. 1. The gases then enter the chamber 38 and pass through nozzles 42. Secondary air from the duct 52 enters the openings 40, burning the gases to completion in the intermediate furnace section 14 in a conventional manner. The capacity for sulfur retention by the gasifying section 86 is maintained by the continuous removal of the sulfated lime and the replenishment of this material with sulfur-free lime through the feeder 100. The sulfated lime, along with the spent fuel particles is discharged from each gasifier 22, 24, 26 and 28 in a conventional manner, such as by a drain pipe, or the like (not shown).

Air from the windbox 50 is also admitted into the regenerating section 88 through the pipe assemblies 96, and the calcium sulfide formed in the gasifying section 86 is circulated through the regenerating section 88 as discussed above, to convert the calcium sulfide to calcium oxide while producing an off-gas with a high sulfur dioxide concentration. As the calcium sulfide is transferred into the oxygen-rich regenerating section 99 preferably at about 1900° F., the following reaction takes place:

$$CaSO_4 + CaS + O_2 \rightarrow 2CaO + 2SO_2$$

The sulfur dioxide formed by the above reaction exits from the regenerating section 88 of each gasifier 22, 24, 26 and 28 through their respective discharge manifolds 110, is combined as discussed above and is recovered by external equipment from the gas stream in the form of elemental sulfur, while calcium oxide is recirculated back to the gasifying section 86 for re-use as a sulfur absorbent.

Referring again to FIG. 1, the combustion gases produced as a result of the combustion of the sulfur-free product gases from the gasifiers 22, 24, 26 and 28 in the intermediate furnace section 14 pass upwardly to the upper furnace section 16 and through the heat recovery area 54 before exiting from the front gas pass 68 and the rear gas pass 70. As a result, the hot gasses pass over the platen superheater 78, the finishing superheater 79 and the primary superheater 74, as well as the reheater 76 and the economizer 72 to add heat to the fluid flowing through these circuits. The hot gases then pass through the air preheater 46 to preheat the air entering the duct 48.

Although not shown in the drawings for clarity of presentation, it is understood that suitable inlet and outlet headers, downcomers and conduits, are provided to place the tubes of each of the aforementioned walls and heat exchangers as well as the roof in fluid communication to establish a "once-through" flow circuit for heating the entering water to vapor. To this end, feedwater from an external source is passed through the economizer 72 to raise the temperature of the water before it is passed through the walls of the gasifiers 22, 24, 26 and 28 and, from the latter walls to the divisional walls 80. From the latter walls, the heated water is passed to inlet headers (not shown) provided at the lower portions of the furnace walls 18, 20 and 21. All of the water flows upwardly in series through the walls 18, 20 and 21 to raise the temperature of the water further, i.e., subcritical or to convert at least a portion of same to vapor, i.e., supercritical, before it is collected in suitable headers located at the upper portion of the vapor generator 10. The fluid is then passed downwardly through suitable downcomers, or the like, and then directed through the walls 60, 62, 64 and 66 of the heat recovery area 54 after which it is collected and passed through the roof 82. From the roof 82, the fluid is passed via suitable collection headers, or the like, to separators (not shown) which, during start-up, separate the vapor portion of the fluid from the liquid portion thereof. The liquid portion is passed from the separators to a drain manifold and heat recovery circuitry (not shown) for further treatment, and the vapor portion of the fluid in the separators is passed directly into the primary superheater 74. From this latter, the fluid is spray attemperated after which it is passed to the platen superheater 78 and the finishing superheater 79 before it is passed in a dry vapor state to a turbine, or the like. After start-up, the separators merely act as transfer headers.

It is understood that the arrangement of the present invention is equally applicable to a natural circulation system utilizing a steam drum or drums in a conventional manner.

As a result of the foregoing a sulfur-free product is produced and is introduced directly into the vapor generator without the need for hot gas ducting and cyclone separators. Also, the furnace can be designed to accept and burn a certain amount of solid particulate carbon which is entrained in the gases exiting from the gasifier; thus eliminating the necessity of burning this carbon periodically in the ducting from gasifier to burners.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. An integral generator/gasifier system comprising a vapor generator including a furnace section formed by four upright walls, a plurality of openings formed in at least one of said walls, a plurality of vertically spaced gasifiers extending adjacent said one wall and surrounding said openings, so that the respective interiors of said gasifiers communicate with said openings, means for introducing fuel to each gasifier, means in each gasifier for supporting a bed of adsorbent material for the sulfur generated as a result of the gasification of said fuel, and means for passing air through said bed of adsorbent material to fluidize said material so that, upon gasification of said fuel, a substantially sulfur-free product gas is produced which passes from said gasifier, through said openings and into said furnace section, such that combustion of the gas and unreacted carbon occurs.

2. The system of claim 1 wherein each gasifier includes means for generating the adsorbent containing said sulfur to produce a sulfur gas.

3. The system of claim 1 wherein said fuel is coal which is introduced into said fluidized bed.

4. The system of claim 1 wherein said fuel is oil which is injected into said fluidized bed.

5. The system of claim 1 wherein said gasifiers are spaced from said one wall of said furnace section to form a gas chamber for receiving gas from said gasifiers and directing said gas to said openings.

6. The system of claim 5 further comprising a plurality of nozzles extending from said gas chamber into said openings for receiving said gas from said gasifiers and introducing it to said furnace section.

7. The system of claim 1 further comprising a windbox surrounding said gasifiers.

8. The system of claim 7 further comprising a source of air, and duct means for passing said air to said windbox.

9. The system of claim 8 further comprising means for passing the combustion gases from said furnace section in a heat exchange relation to said air before said air is passed to said windbox.

10. The system of claim 1 wherein said upright walls of said furnace section and the walls of said gasifier are formed by a plurality of tubes for receiving water to heat said water to vapor.

11. The system of claim 1 wherein said gasifiers are each integrally formed with a sorbent regenerator.

12. The system of claim 1 further comprising means for top supporting said gasifiers and vapor generator to permit thermal expansion in a downward direction.

* * * * *